United States Patent [19]

Clancy

[11] 4,346,917

[45] Aug. 31, 1982

[54] CHECKBOOK ACCOUNTING SYSTEM

[76] Inventor: Bruce N. Clancy, 118 Via Buena Ventura, Redondo Beach, Calif. 90277

[21] Appl. No.: 945,483

[22] Filed: Sep. 25, 1978

[51] Int. Cl.[3] ..... B42D 12/00

[52] U.S. Cl. ..... 283/58; 283/63 A; 283/66 A

[58] Field of Search ..... 282/DIG. 2; 283/57–59, 283/ 63 A, 66 R, 66 A

[56] References Cited

U.S. PATENT DOCUMENTS

| | | | |
|---|---|---|---|
| 728,593 | 5/1903 | Mayberry | 283/66 R |
| 1,003,326 | 9/1911 | Broudy | 283/66 R |
| 2,244,908 | 6/1941 | Finnila | 283/58 |
| 2,869,899 | 1/1959 | Benbassat | 283/57 |
| 3,254,906 | 6/1966 | Moss | 282/23 A |

FOREIGN PATENT DOCUMENTS

| | | | |
|---|---|---|---|
| 10917 | of 1906 | United Kingdom | 283/66 A |

*Primary Examiner*—John McQuade
*Attorney, Agent, or Firm*—Singer & Singer

[57] ABSTRACT

A checkbook register and account record journal system having simplified parameters by utilizing the conventional checkbook entries as an essential part of the journal. The checkbook register sheets are detachably detached along one edge only and used in the conventional manner by listing deposits and withdrawals. The checkbook register sheets are used on only one side with the reverse side preferably having an adhesive backing. The account record sheet forming the journal contains rows and columns on one side with the reverse side adapted to accept the individual checkbook register sheets. Placing the record sheets in a binder produces a complete journal with the reverse side of the record sheet containing the checkbook register sheets and the obverse side of the record sheet containing rows and columns for entering the journal entries.

8 Claims, 2 Drawing Figures

CHECKBOOK ACCOUNTING SYSTEM

This invention relates to a method and apparatus for creating a simplified journal for small business accounts and for the private person and in a manner that minimizes the possibility of error caused by transporting information from the checkbook register sheets to the account record sheets forming the journal.

In the conventional small accounting system, an account record sheet is prepared in which the obverse side has rows and columns adapted to receive check record information such as the payee, amount of the check, date of the check, and other information relative to expenditure of funds.

The reverse side of the account register sheet also contains rows and columns to specifically identify each of the expenditures by classification such as rent, telephone, insurance, etc. A plurality of account record sheets are usually bound together, and together form a complete journal with the reverse side of one sheet facing the obverse side of the second sheet to form the complete listing of expenditures numerically by check and also by classification.

In the conventional or prior art systems, a checkbook register is used separate and distinct from the journal. At some point in time the accountant or the individual must then transfer the information from the check register to the obverse side of the individual sheets forming the journal to thereby complete the accounting transaction.

Reconciliation of the two accounts is usually performed by an accountant who then verifies the deposits and withdrawals of the check register and separately verifies the listing of expenses indicated in the journal.

The prior art discloses different techniques for attempting to minimize errors in transposing information from the register to the journal. These prior art systems usually involve mechanical devices, special checks, peg boards, or other contrivances that may or may not be justified for a large industrial user but are certainly not practical for the small homeowner or small businessman handling his own accounts.

A patent issued June 7, 1966 to J. Moss and assigned U.S. Pat. No. 3,254,906 describes a unitary checkbook system that is adapted to simultaneously prepare a complete record of the transaction each time a check is issued.

A patent issued June 10, 1941 to Alfred A. Finnila and assigned U.S. Pat. No. 2,244,908, discloses still another checkbook and accounting system in which the issuing of a check automatically prepares a finished and complete record of the transaction.

In the practice of the present invention, a conventional checkbook register is used to record the balance due, the payee, the date of the check, the amount of the check, and the balance due in the account. The individual register sheets are preferably attached at one side and are used on only one side. The reverse side is preferably covered with adhesive and usually is blank. In the preferred embodiment the reverse side of the individual checkbook register sheets are blank and contain a dry glue that is adapted to be activated by a suitable liquid. In the practice of the invention, however, any adhesive glue, stapling device, or other means of attaching the register sheets may be used.

Conventional record sheets having a plurality of rows and columns on the obverse side are used. The reverse side which normally contains rows and columns to accept the numerical listing of expenditures is preferably omitted and the space may be left blank.

In the practice of the invention the individual checkbook register sheets when completely filled on one side are then detached from the checkbook register and attached to the reverse side of the account register sheets and placed in alignment so that the columns on the checkbook register sheets are aligned with the columns on the account record sheets.

Depending on the size of the checkbook register sheets used, it is possible to use two, three or even a single checkbook register sheet if one uses the extremely large sheets issued in booklet form.

The individual record sheets are bound with the reverse side of one containing the attached checkbook register sheets facing the obverse side of the second, thereby providing the complete journal without the need of transposing information from a check register into a journal. The accounts are completely stated, the user can see at a glance what his balance is and where his money has been spent, and the categories that he has spent his money in.

The immediate advantages, of course, are the elimination of a second reconciliation of the journal against the checkbook since both documents are now one with the journal containing the check register information as the original source documents.

Further objects and advantages of the apparatus and method disclosed herein are more fully illustrated in the accompanying drawings wherein.

The present invention is intended to supply a conveniently simple accounting system for a small businessman or individual who utilizes checks as part of his everyday activity in paying bills and keeping track of his finances.

The present invention contemplates the use of a separate check register that is separate and apart from the individual checks that are used. Those checkbook systems that utilize a stub on the individual check are not adaptable to the teachings of the present invention.

The size of the individual checks and the size of the individual check register is usually a matter of choice and design and preference of the individual user. For example, one popular size of check is six inches by three inches with the check register contained in a separate booklet form having approximately the same size. Still another popular configuration used primarily by small businesses is the three checks on a page configuration that is approximately $8\frac{1}{2} \times 9$ inches with the check register in a separate booklet form of substantially the same dimensions.

The present invention is adaptable to any size or configuration of register used provided only that the individual check register contains filled-in information on only one side and is readily detachable as will be explained in connection with FIGS. 1 and 2.

Figure 1:
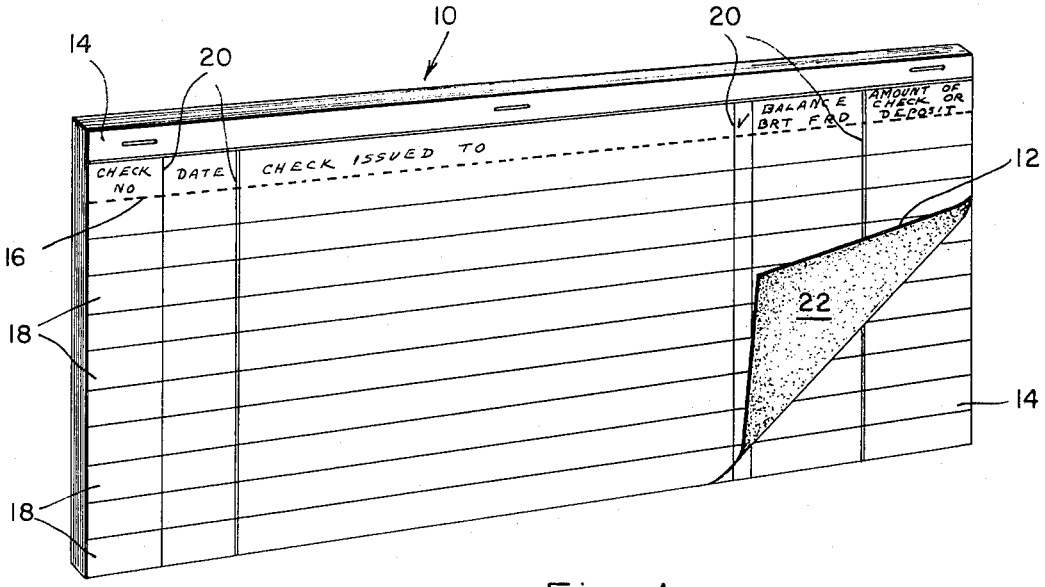
FIG. 1 illustrates a checkbook register.

Referring now to FIG. 1, there is shown for convenience of illustration only, the small size check register having a physical size of approximately 3 inches $\times$ 6 inches. In the preferred embodiment the check register 10 is comprised of a plurality of individual register sheets 12 and 14 detachably secured at one end 14*a* of the check register by means of perforations 16 located on each sheet.

The individual sheets 12 and 14 comprising the check register have the conventional information by means of rows 18 and columns 20 to provide spaces for listing the date, the check number, the payee, the amount of the check, and the balance in the account.

In the preferred embodiment the reverse side of each of the individual check register sheets are blank and contain an adhesive 22. In one embodiment the adhesive 22 is preferably a dry glue adapted to be activated by the application of a suitable liquid.

Figure 2:
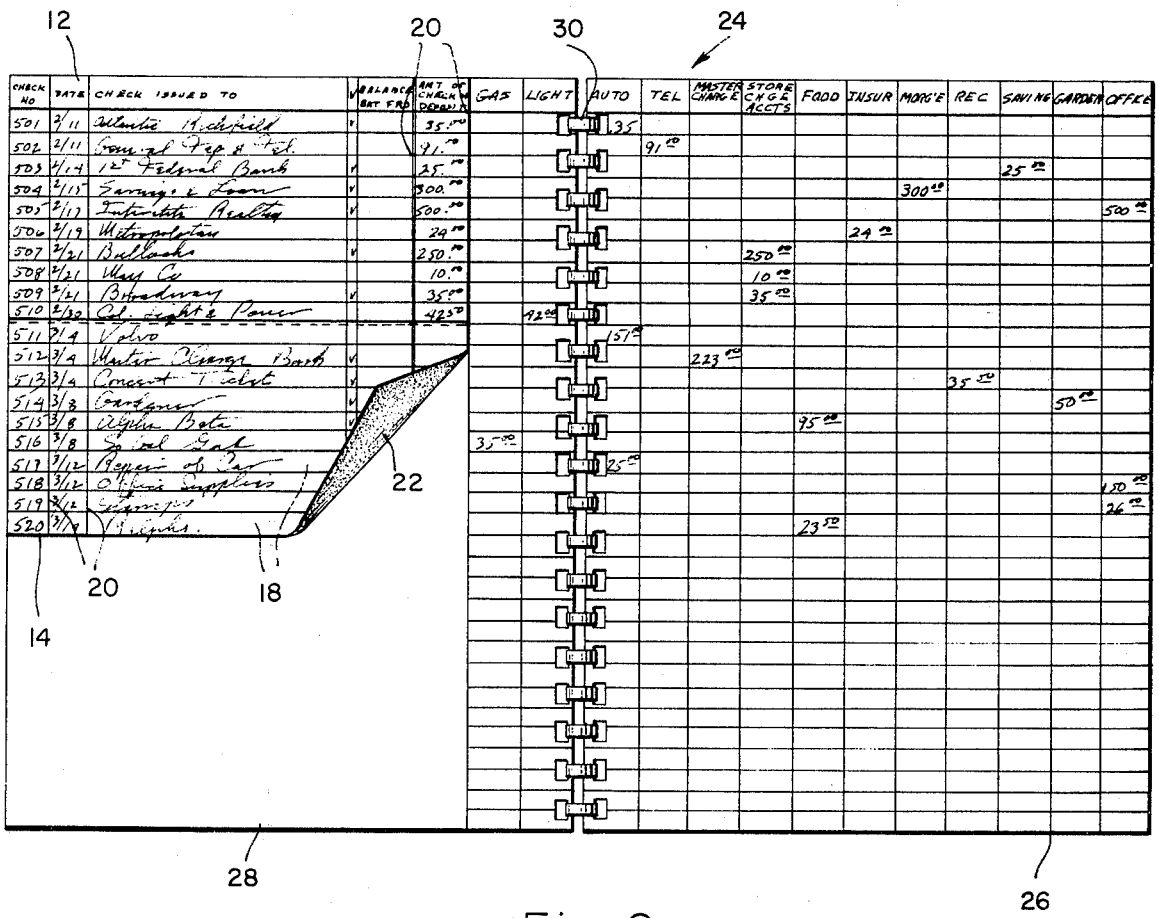
FIG. 2 illustrates a complete journal constructed according to the teachings of the present invention.

Referring now to FIG. 2, there is shown a complete journal 24 comprising a plurality of individual register sheets 26 having rows and columns on the obverse side to identify classes of expenditures such as gas, light, telephone, rent, insurance, food, etc.

The reverse side of the register sheets is illustrated by reference 28 and is preferably blank in order to accept the individual checkbook register sheets 12 and 14.

In the preferred embodiment the individual register sheets are approximately 11 inches by $8\frac{1}{2}$ inches in order to accept the majority of sizes of register sheets presently in use.

For example, utilizing the $11\times8\frac{1}{2}$ size will accept at least three of the $6\times3$ register sheets described above. In the alternative, the same size record sheet will accept a single of the larger size record sheets that approximate $9\times9$ inches as mentioned above.

In the practice of the invention the individual checkbook register sheet 12 when completely filled out is detachably removed from the checkbook register 10 and physically attached to the uppermost side of the reverse side 28 of the record sheet. The record sheet is aligned so that the rows located on the check register are aligned with the rows located on the account record to thereby form contiguous parallel lines. Subsequent checkbook register sheets are then physically attached in tandem to the reverse side 28 of the account record and secured in place with the adhesive 22.

In actual practice the complete journal is bound at one end by means of a suitable binder such as rings 30 and the complete journal is comprised of the reverse side 28 of a first account record facing the obverse side of the next account record sheet thereby exposing to the viewer and user a complete journal for his use and review.

By utilizing the information on the check register directly into the journal system, duplication and transposition errors are eliminated.

The disclosed method of creating a new journal is highly adaptable to the individual and the small businessman in view of the elimination of the dual posting and the elimination of the possibility of errors in having a dual posting.

I claim:

1. A checkbook register and account record journal system comprising:

a plurality of checkbook register sheets each arranged to receive check information on a single line detachably secured on one end, each of said register sheets having a plurality of spaced apart parallel lines on the obverse side for recording additional check information, an account record journal sheet having a plurality of spaced apart parallel lines on the obverse side adapted to be aligned with said lines on said register sheets for indicating specific headings according to task for each check, the reverse side of said checkbook register sheet adapted to be attached to said record journal sheet, and said account record journal sheet adapted to receive and hold said register sheets aligned to form contiguous parallel lines with said account record journal sheet thereby providing a complete journal page having check information, deposit information and journal information and from a single entry.

2. A checkbook register and account record journal system according to claim 1 in which the reverse side of said checkbook register sheets include adhesive for fixedly attaching and holding said checkbook register sheets in alignment on said account record journal sheet.

3. A checkbook register and account record journal system according to claim 2 in which said adhesive is dry glue adapted to be energized by the application of a suitable liquid.

4. A checkbook register and account record journal system according to claim 1 in which said account record journal sheet is sized to accept a plurality of said checkbook register sheets in tandem each aligned to form contiguous parallel lines with said account record sheet.

5. A checkbook register and account record journal system according to claim 1 in which the reverse side of said checkbook register sheets and the reverse side of said account record journal sheets are substantially blank.

6. A checkbook register and account record journal system according to claim 1 in which the reverse side of said checkbook register sheet is adapted to be attached to the reverse side of said account record sheet.

7. A checkbook register and account record journal system comprising:

a plurality of account record journal sheets having a blank reverse side and rows and columns on the obverse side, and a checkbook register sheet having a blank reverse side and rows and columns on the obverse side, the blank side of said register sheet adapted to be fixedly attached to the blank reverse side of said account record journal sheet with the rows on said checkbook register sheet aligned with the rows on said account record journal sheet for providing a complete journal page having check information, deposit information and journal information and from a single entry.

8. A method for creating a journal system comprising the steps of:

first preparing a checkbook register sheet by using only one side of the checkbook register sheet until full, selecting an account record journal sheet and then attaching each full register sheet to the reverse side of the account record journal sheet, and then binding a plurality of register sheets together with the reverse side of one facing the obverse side of another to form a complete journal.

* * * * *